US011800624B2

(12) United States Patent
Kodadek, III et al.

(10) Patent No.: US 11,800,624 B2
(45) Date of Patent: Oct. 24, 2023

(54) LIGHTING CONTROL SYSTEM AND METHOD

(71) Applicant: BLACK TANK, LLC, Haverhill, MA (US)

(72) Inventors: Robert E. Kodadek, III, Long Beach, NY (US); Michael W. Johnson, Amesbury, MA (US); Douglas A. Johnson, Mt. Holly, NC (US)

(73) Assignee: Black Tank, LLC, Haverhill, MA (US)

( * ) Notice: Subject to any disclaimer, the term of this patent is extended or adjusted under 35 U.S.C. 154(b) by 0 days.

(21) Appl. No.: 17/543,076

(22) Filed: Dec. 6, 2021

(65) Prior Publication Data

US 2022/0183132 A1 Jun. 9, 2022

Related U.S. Application Data

(60) Provisional application No. 63/121,521, filed on Dec. 4, 2020.

(51) Int. Cl.

| | |
|---|---|
| ***H05B 47/18*** | (2020.01) |
| ***H05B 45/20*** | (2020.01) |
| ***H05B 47/155*** | (2020.01) |
| ***H05B 47/185*** | (2020.01) |
| ***F21S 10/02*** | (2006.01) |
| *F21Y 115/10* | (2016.01) |

(52) U.S. Cl.

CPC ..... *H05B 47/18* (2020.01); *F21S 10/02* (2013.01); *H05B 45/20* (2020.01); *H05B 47/155* (2020.01); *H05B 47/185* (2020.01); *F21Y 2115/10* (2016.08)

(58) Field of Classification Search

CPC ..... H05B 47/18; H05B 45/20; H05B 47/155; H05B 47/185; F21S 10/02; F21Y 2115/10

See application file for complete search history.

(56) References Cited

U.S. PATENT DOCUMENTS

| | | | | |
|---|---|---|---|---|
| 5,329,431 A * | 7/1994 | Taylor | G05B 19/0421 | 362/85 |
| 6,493,095 B1 * | 12/2002 | Song | H04N 13/254 | 250/237 G |
| 6,653,802 B1 * | 11/2003 | Nelson | H05K 7/1461 | 361/752 |
| 10,237,939 B2 * | 3/2019 | Coombes | H05B 47/11 | |
| 2009/0066266 A1 * | 3/2009 | Jungwirth | H05B 47/18 | 315/307 |

(Continued)

FOREIGN PATENT DOCUMENTS

CN 105763256 A * 7/2016 ..... H04B 10/07955

OTHER PUBLICATIONS

CN-105763256-A, npl (Year: 2016).*

*Primary Examiner* — Tracie Y Green
(74) *Attorney, Agent, or Firm* — Brooks Kushman P.C.

(57) ABSTRACT

A system and method for controlling a lighting system may be integrated into a lighting fixture or into a stand-alone device. A plurality of inputs defining one or more lighting parameters may be received. The inputs may include input signals characterized by at least two different control protocols. The input signals may be combined into an output signal characterized by a single control protocol, and the output signal used to control the lighting system.

23 Claims, 5 Drawing Sheets

(56) References Cited

U.S. PATENT DOCUMENTS

| | | | | |
|---|---|---|---|---|
| 2012/0001841 | A1* | 1/2012 | Gokingco | H05B 47/11 702/85 |
| 2012/0224375 | A1* | 9/2012 | Zaderej | F21K 9/20 362/249.02 |
| 2014/0218511 | A1* | 8/2014 | Lee | G01J 3/505 348/135 |
| 2015/0237700 | A1* | 8/2015 | Woytowitz | H05B 45/382 315/307 |
| 2017/0265266 | A1* | 9/2017 | Murray | H05B 45/10 |
| 2017/0273164 | A1* | 9/2017 | Kirmayer | H05B 47/19 |
| 2018/0070419 | A1* | 3/2018 | Girard | H05B 47/195 |
| 2019/0075635 | A1* | 3/2019 | Wray | H05B 47/18 |

* cited by examiner

LIGHTING CONTROL SYSTEM AND METHOD

CROSS-REFERENCE TO RELATED APPLICATIONS

This application claims the benefit of U.S. provisional application Ser. No. 63/121,521 filed Dec. 4, 2020, which is hereby incorporated by reference herein in its entirety.

TECHNICAL FIELD

The present disclosure relates to a system and method for lighting control.

BACKGROUND

In many situations it may be desirable to control various aspects of the light being emitted from a lighting fixture. For example, a standard dimmer switch may be used to vary the brightness or intensity of the light, while more sophisticated systems may control the color or even the temperature of the light—i.e., a "warmer" or "cooler" variation of the same light color. Although different protocols may be used to control the desired outputs of different lighting fixtures, it is common for any given lighting fixture to accept only a single control protocol. In the case of a typical residential light dimmer, a triode-alternating-current switch, or "triac", may be used to dim or brighten the emitted light. Another common type of control is referred to as a "0-10v" dimmer, which allows direct-current voltage to be varied between zero and ten volts to change the intensity of the light output.

In modern lighting control-systems there are any number of different protocols that may be chosen to control aspects of the light—e.g., DMX, remote-device management (RDM), or digital addressable lighting interface (DALI). Similar to the triac dimmer switch or the 0-10v system described above, at least some of these protocols can be used to control the intensity of the light emitted from a lighting fixture. Where the lighting fixture includes multiple light emitting diodes (LEDs), these protocols may also be used to control the individual intensities of the LEDs within the fixture. For lighting fixtures that contain LEDs of different colors, a single protocol such as DMX can be used to vary the brightness of each LED or a group of LEDs. Selectively increasing the brightness of some colors, while decreasing or holding constant the brightness of other colors, results in a change in the perceived color of the light being emitted from the lighting fixture. A protocol such as DMX may also be used to control different shades of a single color—i.e., the temperature—where the lighting fixture includes LEDs of different shades of a single color. In other situations, additional controls may be available to the user including remote or motorized-beam-angle control and focus control.

In addition to the control systems and protocols described above, wireless-control protocols can also be used to control lighting fixtures. Examples of wireless protocols include generic Bluetooth communications, infrared, ZigBee, Casambi, WiFi, and wireless mesh networks. Similar to the protocols described above, these wireless protocols can be used to adjust the global intensity of a light, the individual colors of a light, or other features such as a beam angle. In some applications, it may be desirable to use fixtures with different lighting-control protocols in the same control-system installation. For example, if a fixture's lighting control protocol is DALI and it is desired to also install a fixture on the same control system that utilizes DMX control, multiple control protocols may be necessary. In this situation, it may not be possible to achieve global control, so fixture selection may be limited to lights that utilize a single lighting-control protocol. And because of the lighting-protocol-control requirements of each fixture, the control source—e.g., a DMX console—must remain in place after the initial lighting system configuration has been completed to provide control to the user. It would therefore be desirable to have a system and method for lighting control that overcomes some or all of the above-identified limitations of current control systems.

SUMMARY

At least some embodiments described herein may include a control system that allows a user to implement at least two different lighting protocols simultaneously to control a lighting system that includes a lighting fixture or fixtures. In one example, one control protocol may be used to adjust the temperature of a tunable-white-light product or the colored-light output of a color-mixing fixture, while a second protocol may be used to increase or decrease the global intensity of the light.

At least some embodiments described herein may include a control system including at least one microprocessor and configured to receive a plurality of inputs defining respective lighting parameters. The inputs may include signals characterized by at least two different control protocols, and the control system may be further configured to combine the signals and provide a first output signal characterized by a single control protocol to the lighting system to control the lighting system according to the inputs. The at least two different control protocols may include a DMX protocol and a 0-10v protocol, and the first output signal may be characterized by a DMX protocol. The lighting system may include a plurality of lighting fixtures, and the first output signal may be sent to each of the lighting fixtures, so that each of the lighting fixtures is controlled the same. The control system may be configured to provide a second output signal such that at least one of the lighting fixtures is controlled according to the first output signal and at least one other of the lighting fixtures is controlled according to the second output signal. The first and second output signals may be characterized by the single control protocol.

At least some embodiments described herein may include a method for controlling a lighting system. The method may include receiving a plurality of inputs into a control system having at least one microprocessor. Each of the inputs may define one or more lighting parameters and include signals characterized by at least two different control protocols. The method may also include combining the signals into a single control protocol and outputting a first output signal characterized by the single control protocol to the lighting system to control the lighting system according to the inputs.

At least some embodiments described herein may include a control system that can be used in conjunction with a control protocol that is already being used—i.e., a "legacy" protocol—such as may be provided by a 0-10v dimmer. For example, when a new color-mixing or tunable-white-light fixture is installed in a location that uses a switch that employs a legacy 0-10v protocol, and it is desired to have the new fixture work in conjunction with the existing switch—and therefore the legacy protocol—embodiments of a control system described herein may provide a separate protocol to further control the new fixture. More specifically, the existing switch can be connected to the new fixture and used to control the dimming, while the control system can use a different protocol to control the color or temperature of the light emitted from the new fixture. This allows an existing dimmer to control the intensity of the light emitted from existing lighting fixtures to which it is connected, while also allowing the new control system with its separate protocol to be used to change the color or temperature of the light emitted from any new fixtures it controls.

At least some embodiments described herein may include a control system that can be integrated into a lighting fixture or a stand-alone device separate from a lighting fixture. The stand-alone device may be, for example, contained in a housing that may be free-standing, mounted on a wall or cabinet, integrated or installed into lighting-track systems, or otherwise packaged for convenience and aesthetic qualities. In at least some of these embodiments, the stand-alone device can be used with legacy fixtures that require the use of a single control protocol. The stand-alone device may then be used to combine two protocols—the existing protocol and a second protocol—into a single protocol that is usable by the existing fixture. This allows the control system to be used in retrofits and applications where legacy systems are present.

In one example, it may be desirable to use a 0-10v dimmer to control the intensity of lights in an existing lighting fixture that only supports a DMX protocol. In a situation such as this, embodiments of a control system described herein—e.g., the stand-alone device described above—can be configured to interact with both the existing lighting fixture, the DMX controller, and a 0-10v dimmer. Assuming that the existing lighting fixture has some blue and some red LEDs, a control system as described above can be used to combine the existing DMX control with the 0-10v intensity control. More specifically, the DMX controller may be controlled to set the blue LEDs to full brightness and the red LEDs to half brightness to create a desired purple color. The ratio of blue/red intensity set by the DMX controller may then be attenuated using the existing 0-10v dimmer, thereby providing inputs using two different control protocols to the control system. The control system may then create a new resultant attenuated DMX signal that could be sent to the existing fixture that is configured for DMX control only.

In other embodiments, multiple fixtures that require a specific type of control can be individually addressed. For this application, the control system may utilize a first input usable by all the fixtures to set the color output for each fixture. In some applications, all the light fixtures may be controlled to emit the same color of light. In other applications, some or all of the fixtures may be controlled to emit light with different colors, which may require at least some of the fixtures to have a unique identifier that is recognized by the controlling protocol. The ratio of colors for each fixture may then be stored by the control system and used in conjunction with a 0-10v dimmer to provide intensity control to all the controlled lighting fixtures connected to the control system.

In a specific example, a lighting fixture may include LEDs of four different colors, and it may be desired to control the brightness of the lights—e.g., with a 0-10v dimmer—and the color of the lights. Embodiments of control systems described herein can be configured to use a DMX/RDM protocol to set a desired output color by controlling the four different-colored LEDs (or "four channels") individually, while the 0-10v dimmer can provide global-dimming control for the fixture by modulating the brightness of all four channels. After each LED intensity (brightness) is set, the DMX/RDM controller can remain connected to provide for future color control—e.g., via individual or group LED adjustments—or it can be removed to allow the color to remain static while overall brightness control is managed by the 0-10v dimmer.

A profile of a fixture—sometimes called a "personality"—can be controlled in accordance with embodiments described herein. For example, RDM is part of the DMX/RDM control protocol that can further enhance the implementation of a control system described herein. In one example, a standard four-channel RDM personality (Personality#1) can be selected by a DMX/RDM console where each of the "RGBA" channels are controlled individually via DMX, thus allowing the user to establish a custom color or custom white correlated-color-temperature (CCT). The RGBA channels include the standard red, blue, and green channels of "RGB", and an additional amber channel. Once the color has been selected by the control system, it can be saved in the fixture or in a stand-alone device. Alternately, the DMX/RDM controller can use RDM to put the lighting fixture into a new, single-channel personality (Personality#2) where the previously set intensity of the four channels is now saved. Once saved, the color can be dimmed as a group with one channel of DMX or via a 0-10v dimmer. In the case where the DMX/RDM console is removed and there is no longer any DMX data present, the 0-10v input will by itself control the brightness of the combined custom LED light output.

In yet another embodiment of a multi-protocol control implementation, a four-channel DMX/RDM console can independently control the four colors of LEDs while simultaneously allowing the 0-10v input to further modulate the brightness of the combined color mix. This effectively allows the 0-10v dimmer switch to act as a global dimmer for the brightness of the custom color mix determined by the DMX/RDM console. In this case, however, the colors may not be saved, but can be continuously mixed by a user with the DMX/RDM protocol, and can also be simultaneously dimmed with the 0-10v dimmer switch.

In other embodiments, a legacy lighting or wireless control may be used in conjunction with the control system to enable global control of fixtures with one or more control input requirements—e.g., Fixture 1=DALI, Fixture 2=DMX, Fixture 3=0-10v, etc. In this type of application, one or more lighting-control protocols or wireless inputs may be provided to the control system, which would subsequently provide one or more corresponding lighting-control outputs to connected lighting fixtures. In this situation, the control system could provide one or more lighting-control protocols for more advanced fixtures and for legacy fixtures—e.g., triac dimming or 0-10v control—simultaneously in the same system. Global dimming could be provided using any one of the input sources including the legacy-dimmer-, wired-, or wireless-control protocols—e.g., an application via a mobile device with Bluetooth connectivity. In some applications, complex control may not be needed following the initial setup of the system, but global-brightness control may still be necessary—for example, to turn the lights on and off in a museum. In an embodiment of a multi-control implementation as described above, the control system may allow for a single control source to provide multiple-lighting-protocol outputs to support different fixture input needs—for example, a 0-10v input to control global brightness, and DALI and DMX output to control fixtures with these input requirements.

In other embodiments, the control system may store lighting-fixture-specific data, which may allow customized control applications and presets to be developed for more accurate control of each specific fixture. Lighting data may include a variety of specific characteristics including manufacturers' designations and specifications, photometric data on the LEDs—e.g., lumens, color-rendering index (CRI), intensity of each LED color, specific color data—and control protocols such as DMX with or without RDM, or DALI. This data may be provided by the manufacturer or could be sampled from the fixture directly using photometric techniques. Lighting-fixture-specific data can be used to provide accurate color, intensity, and unique-feature control, such as a motorized beam angle. The data may also provide the ability to match colors on fixtures manufactured with different LEDs or with different internal-driver configurations that are used in the same installation.

and

Figure 6:
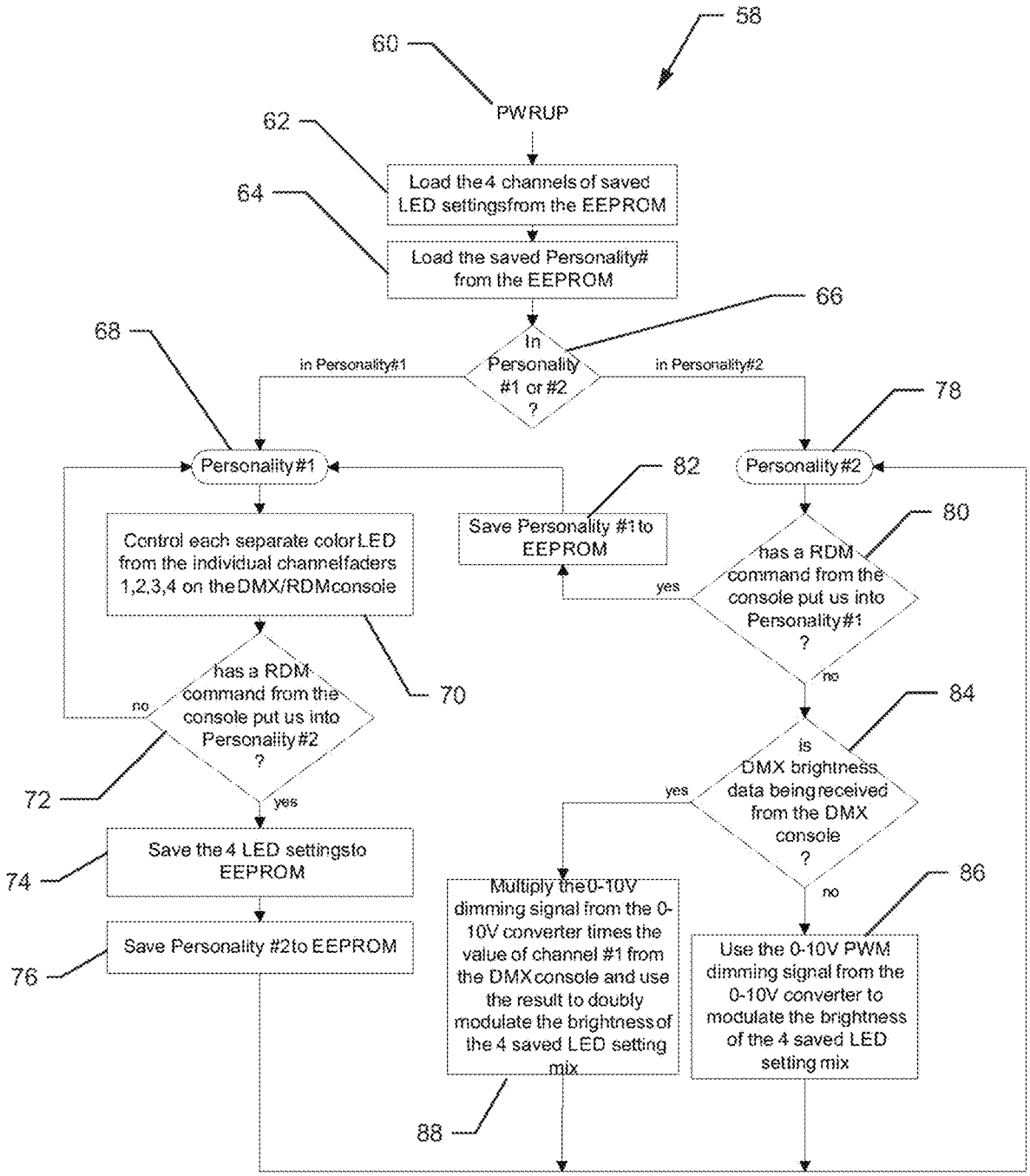

FIG. 6 shows a flowchart illustrating a method in accordance with embodiments described herein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
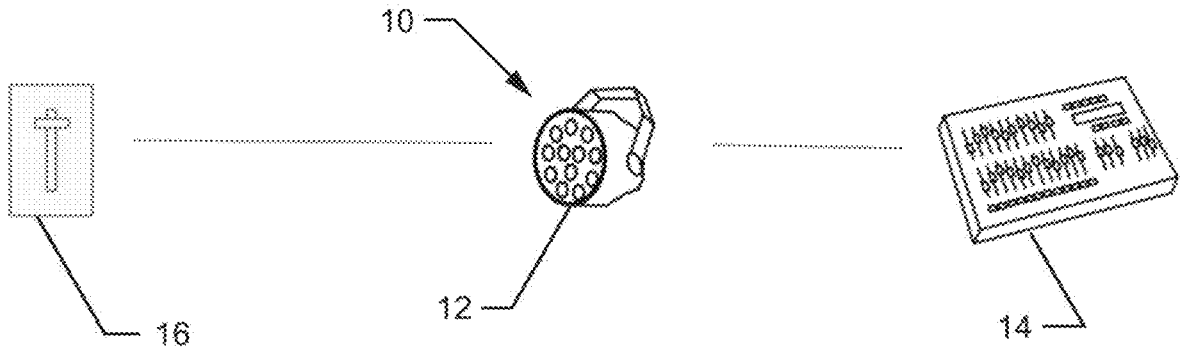
FIG. 1 shows a lighting control system integrated into a lighting fixture in accordance with embodiments described herein being used in conjunction with a dimmer-control protocol and a DMX-control protocol.

FIG. 1 shows a control system 10 in accordance with embodiments described herein. In this embodiment, the control system 10 is integrated into a lighting fixture 12. The lighting fixture 12 is connected to two different types of controllers: a DMX controller 14 and a 0-10v dimmer controller 16. As described above, the control system 10 is configured to control a lighting system—such as the lighting fixture 12—by receiving control signals from two different types of controllers 14, 16 to allow the lighting fixture 12 to emit light that is controlled by two different protocols. For example, the DMX controller 14 may provide signals to the control system 10 to control the color, temperature, or both, of the light emitted from the lighting fixture 12, while the 0-10v dimmer 16 provides signals using a second, different protocol to control the intensity of the emitted light.

Figure 2:
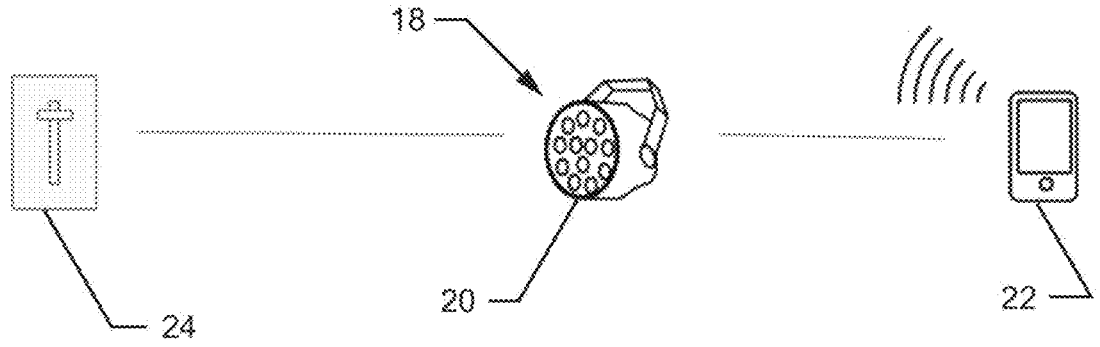
FIG. 2 shows a lighting control system integrated into a lighting fixture in accordance with embodiments described herein being used in conjunction with a dimmer-control protocol and a wireless control protocol.

FIG. 2 shows a control system 18 in accordance with embodiments described herein; it is also integrated into a lighting fixture 20. In this embodiment, however, the lighting fixture 20 is connected to a wireless controller 22, which may communicate with the control system 18, for example, using a Bluetooth protocol. The wireless controller 22 may, for example, control the color of the light emitted from the lighting fixture 20, it may control the temperature of the emitted light, or both. Similar to the example shown in FIG. 1, the lighting fixture 20 is also connected to a 0-10v dimmer 24, which provides signals to the control system 18 using a second, different protocol to control the intensity of the emitted light.

Figure 3:
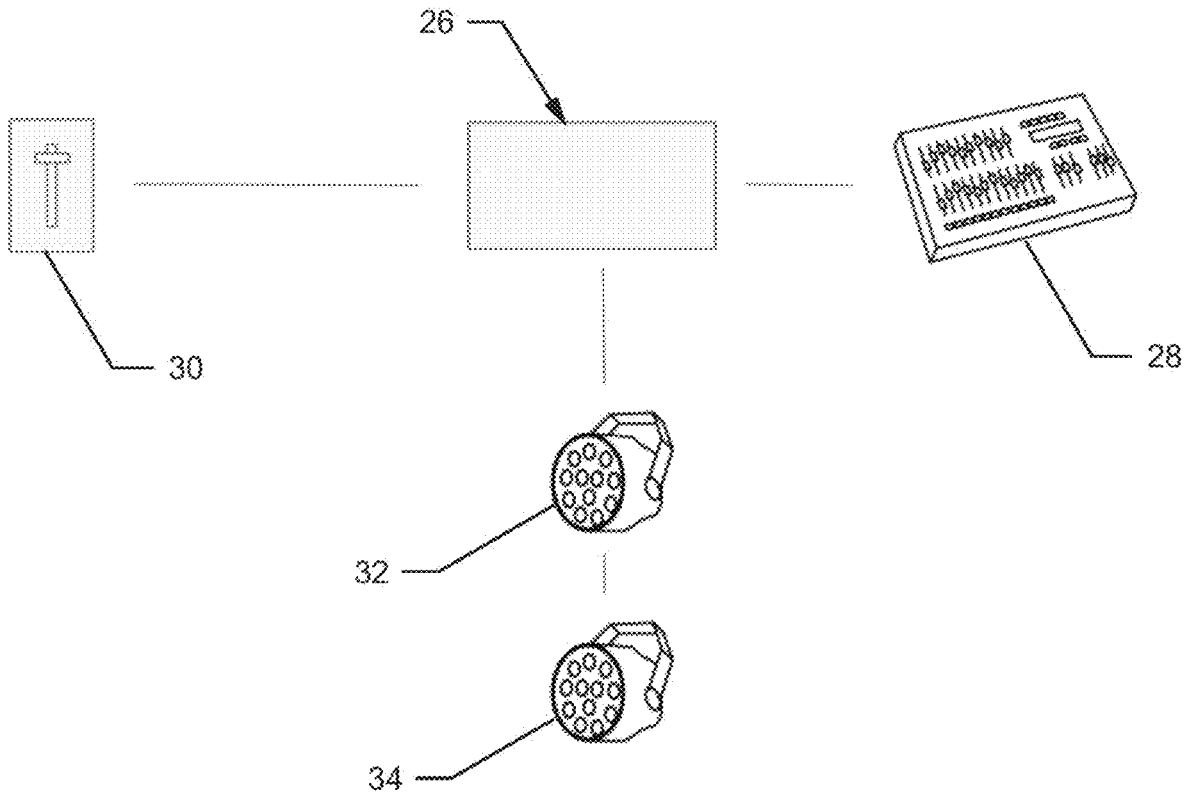
FIG. 3 shows a lighting control system integrated into a stand-alone device in accordance with embodiments described herein used in conjunction with a dimmer-control protocol and a DMX-control protocol and operating more than one light fixture.

FIG. 3 shows a control system 26 in accordance with embodiments described herein. In this embodiment, the control system 26 is configured as a stand-alone device. Similar to the embodiment shown in FIG. 1, the control system 26 is connected to both a DMX controller 28 and a 0-10v dimmer controller 30. In this example, there are two lighting fixtures 32, 34 connected directly to the control system 26. Unlike the lighting fixtures 12, 20, which include an integrated controller configured to receive multiple control protocols, the lighting fixtures 32, 34 are standard lighting fixtures, and are capable of receiving only a single control protocol. In this embodiment, the lighting fixtures 32, 34 are configured to accept control signals that use the DMX protocol, which may, for example, set color ratios for the lights, the temperature of the light being emitted, or both. The lighting fixtures 32, 34 are not configured to accept signals that use the 0-10v protocol. The control system 26 overcomes this limitation, however, by using the control signals received from the DMX controller 28 and from the 0-10v dimmer controller 30, and combining them into an integrated DMX signal or signals.

The 0-10v dimmer controller 30 is used to control the intensity of the light emitted from the lighting fixtures 32, 34, but it must do so through the control system 26 because the lighting fixtures 32, 34 are not configured to accept this control protocol. This illustrates another advantage of the control system 26: if the control provided by the DMX controller is no longer needed—e.g., control of the color or temperature is not required—then the lighting fixtures 32, 34 can still be controlled with the 0-10v dimmer controller 30. This may not be possible without a control system, such as the control system 26.

In applications where it is desirable to use both the 0-10v dimmer controller 30 and the DMX controller 28, the control system 26 receives the signals from the 0-10v dimmer controller 30 and combines them with the control information from the DMX controller 28, which may have been previously received and stored by the control system 26. The instruction sets from the two different controllers 28, 30—each of which uses a different control protocol—is combined by the control system 26 to create a unified DMX control signal. In some embodiments, the same control signal may be sent to both lighting fixtures 32, 34 to control them the same.

In other embodiments, each of the lighting fixtures 32, 34 may have a unique address identifying them to the control system 26 and the DMX controller 28. In that situation, the DMX controller 28 may send separate control signals for each of the two lighting fixtures 32, 34 to the control system 26, which stores these signals separately. Then when the 0-10v dimmer controller 30 sends its signal to the control system 26, two different unified DMX control signals are created by and output from the control system 26 to separately control the lighting fixtures 32, 34. Although only two lighting fixtures are illustrated in this example, a control system, such as the control system 26, may be configured to separately control any number of different lighting fixtures or groups of lighting fixtures if they are identified within the control system by groups rather than individually.

Although the controller 28 in this example is a DMX controller, other controllers may be used in conjunction with a 0-10v dimmer, such as an application on a mobile device like a smart phone. Instead of the DMX controller 28, the smart phone can provide a wireless signal to the control system 26, which in turn can generate the one or more lighting-control protocols needed to control the colors—and the brightness as defined by the 0-10v dimmer—of the output of the lighting fixtures 32, 34. In the embodiment in FIG. 3, both lighting fixtures are configured to accept the same protocol, but other embodiments of a control system, such as the control system 26, may be configured to control multiple light fixtures, some or all of which accept different protocols.

Figure 4:
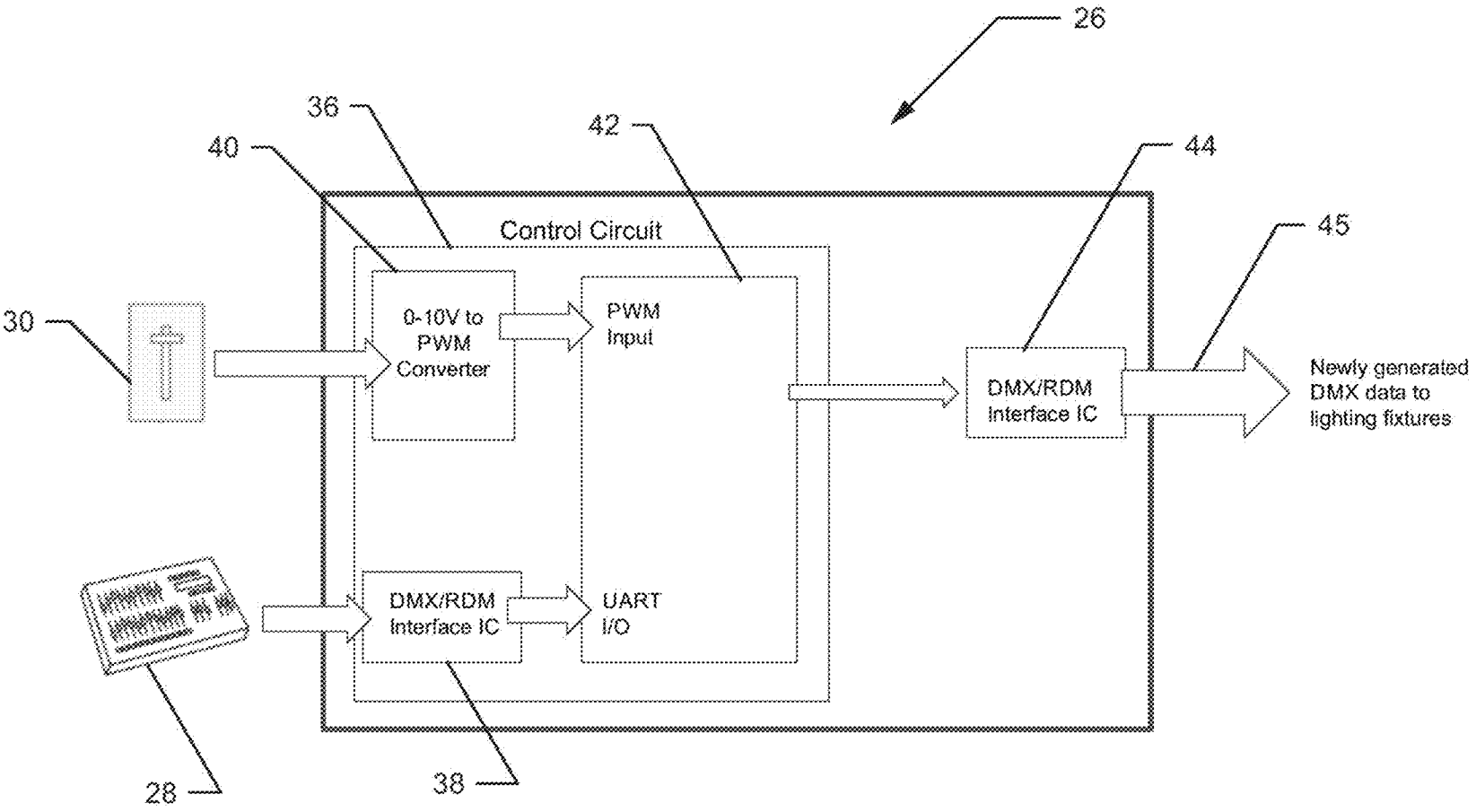
FIG. 4 shows a schematic representation of the control system shown in FIG. 3.

FIG. 4 shows a schematic representation of how an embodiment of the control system 26 may be configured. As shown in FIG. 4, the control system 26 includes a control circuit 36 that receives inputs from both the DMX controller 28 and the 0-10v dimmer 30. More specifically, the output from the DMX controller 28 is received by a DMX/RDM interface 38, which may be, for example, a TI SN75176 RS485 IC. The output from the 0-10v dimmer 30 is received by a pulse-width-modulation (PWM) converter 40, which may be, for example, an Infineon CDM10V 0-10 Interface IC. The outputs from both the DMX/RDM interface 38 and the PWM converter 40 are received in another portion 42 of the control circuit 36, which may be, for example a Microcontroller PIC18F46K22. More specifically, the output from the PWM converter 40 is received as a PWM input, while the output from the DMX/RDM interface 38 is received as a universal asynchronous receiver/transmitter (UART) input. It is in this portion 42 of the control circuit 36 that the inputs are combined and provided as an output to a DMX/RDM interface 44, which may be the same as the DMX/RDM interface 38. The output 45 from the DMX/RDM interface 44 is sent to the lighting fixture or fixtures to be controlled, for example, the lighting fixtures 32, 34 shown in FIG. 3.

Figure 5:
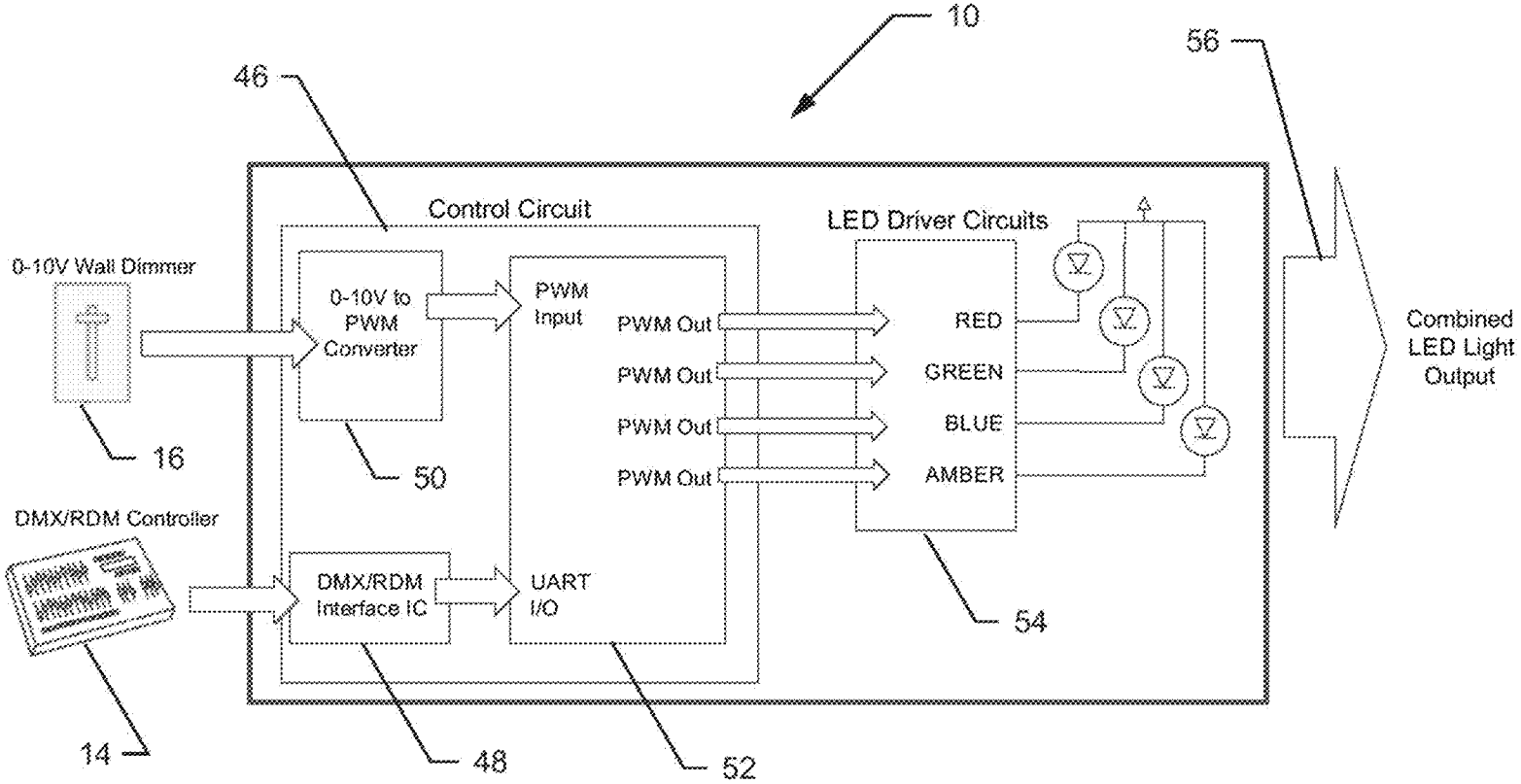
FIG. 5 shows a schematic representation of the control system shown in FIG. 1.

FIG. 5 shows a schematic representation of how an embodiment of a control system, such as the control system 10 shown in FIG. 1, may be configured. As described above, the control system 10 may be integrated into a lighting fixture, such as the lighting fixture 12. As shown in FIG. 5, the control system 10 includes a control circuit 46 that is configured similarly to the control system 26 illustrated in FIG. 4. Specifically, the control circuit 46 receives inputs from both the DMX controller 14 and the 0-10v dimmer 16. The output from the DMX controller 14 is received by a DMX/RDM interface 38, which, like the DMX/RDM interfaces 38, 44 shown in FIG. 4, may be, for example, a TI SN75176 RS485 IC. The output from the 0-10v dimmer 16 is received by a pulse-width-modulation (PWM) converter 50, which, like the PWM converter 40 shown in FIG. 4, may be, for example, an Infineon CDM10V 0-10 Interface IC. The outputs from both the DMX/RDM interface 48 and the PWM converter 50 are received in another portion 52 of the control circuit 46, which may be, for example a Microcontroller PIC18F46K22. In this embodiment, the output from the PWM converter 50 is received as a PWM input, while the output from the DMX/RDM interface 48 is received as a UART input. It is in this portion 52 of the control circuit 46 that the inputs are combined and provided as four outputs to LED driver circuits 54. The outputs from the LED driver circuits 54 are combined into a single LED light output 56 and sent to the lighting fixture or fixtures to be controlled, for example, the lighting fixture 12 shown in FIG. 1.

As described above, embodiments described herein may include a control system configured to control one or more lighting fixtures using one or more different control protocols. FIG. 6 is a flowchart 58 and illustrating a method in accordance with embodiments described herein. The method illustrated in the flowchart 58 may be, for example, executed by a control system also in accordance with embodiments described herein—for example, the control system 10 or the control system 26. The method begins at step 60, where the control system is powered up. At step 62, the LED settings from the EEPROM are loaded—in this example there are four different channels, or four different colors, of LEDs, each with its own settings. At step 64, a previously saved personality, or lighting profile, is loaded from the EEPROM. At decision block 66, it is determined whether the control system is to control the LEDs according to Personality #1 or Personality #2.

If it is determined at step 66 that the control system is to control the LEDs in accordance with Personality #1, this is identified at step 68 and the method moves to step 70 where control of the separate LEDs occurs. At decision block 72, it is determined whether the control system has an RDM command from one of the inputs to have the control system control the lights according to Personality #2. If the answer is "no", then the method loops back to step 68 and the control system is again controlling the lights according to Personality #1. If, however, the answer to decision block 72 is "yes", then the method moves to step 74 where the four LED settings are saved to the EEPROM. At step 76, Personality #2 is saved to the EEPROM, and the method indicates that the control system is controlling the lights according to Personality #2—this is shown at step 78.

At decision block 80, it is determined if the control system has an RDM command from one of the inputs to have the control system control the lights according to Personality #1. If the answer is "yes", then at step 82 the control system saves Personality #1 to EEPROM and the method loops back to step 68. If it is determined at decision block 80 that there is no RDM command to have the control system control the lights according to Personality #1, then a determination is made at decision block 84 whether DMX brightness data is being received from the DMX input. If the answer is "no", then the control system uses a PWM dimming signal to modulate the brightness of the four LEDs. If, however, the answer is "yes, then the PWM dimming signal is multiplied by the value of channel #1 from the DMX input, and the result is used to modulate the brightness of the four LEDs. Although the steps of the method illustrated in the flowchart 58 are shown and described in a particular order, it is understood that other embodiments may perform these steps in a different order, and other embodiments may include additional steps or fewer steps than are shown in FIG. 6.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A control system for controlling a lighting system, comprising:

a control system including at least one microprocessor and configured to receive a plurality of inputs defining respective lighting parameters, the inputs including input signals characterized by at least two different control protocols, the input signals including a first input signal defining a color ratio and a second input signal defining an intensity, the first input signal being received from a color controller connected to the control system and configured to set the color ratio to define a desired output color, the second input signal being received to the control system from a dimmer configured to set the intensity; and use the input signals to control the color ratio and the intensity of the lighting system.

2. The control system of claim 1, wherein the control system is further configured to combine the input signals into a single control protocol to control the lighting system.

3. The control system of claim 1, wherein the lighting system includes a lighting fixture, and the control system is integrated into the lighting fixture.

4. The control system of claim 1, wherein the first input signal utilizes a DMX protocol and the second input signal utilizes a 0-10v protocol, and the control system is further configured to combine the first input signal and the second input signal and output a first output signal in the DMX protocol.

5. The control system of claim 1, wherein the lighting system includes a plurality of lighting fixtures, and the control system is further configured to output at least a first output signal and to send the first output signal to each of the lighting fixtures.

6. The control system of claim 5, wherein the first output signal controls at least one of the lighting fixtures differently from at least one other of the lighting fixtures.

7. The control system of claim 1, wherein the lighting system includes a plurality of lighting fixtures, and the control system is further configured to output at least a first output signal and a second output signal and to send the first output signal to at least one of the lighting fixtures and send the second output signal to at least one other of the lighting fixtures.

8. The control system of claim 7, wherein the first output signal and the second output signal are characterized by the same control protocol.

9. A control system for controlling a lighting system, comprising:

a control system including at least one microprocessor and configured to receive a plurality of input signals defining respective lighting parameters, the input signals being characterized by at least two control protocols, the input signals including a first input signal using a digital protocol to define a color ratio and a second input signal using an analog protocol to define an intensity, the first input signal being received from a color controller connected to the control system and configured to set the color ratio to define a desired output color, the second input signal being received to the control system from a dimmer configured to set the intensity, the control system being further configured to control the lighting system in accordance with the color ratio and the intensity.

10. The control system of claim 9, wherein the lighting system includes a plurality of lighting fixtures, and the control system is further configured to output at least a first output signal and to send the first output signal to each of the lighting fixtures.

11. The control system of claim 10, wherein the first output signal controls at least one of the lighting fixtures differently from at least one other of the lighting fixtures.

12. The control system of claim 9, wherein the lighting system includes a plurality of lighting fixtures, and the control system is further configured to output at least a first output signal and a second output signal and to send the first output signal to at least one of the lighting fixtures and send the second output signal to at least one other of the lighting fixtures.

13. The control system of claim 12, wherein the first output signal and the second output signal are characterized by the same control protocol.

14. The control system of claim 9, wherein the at least two control protocols include at least two different control protocols.

15. The control system of claim 9, wherein the control system is further configured to combine the first input signal and the second input signal and output a first output signal characterized by the digital protocol.

16. A method for controlling a lighting system, comprising:

receiving a plurality of inputs into a control system having at least one microprocessor, each of the inputs defining one or more respective lighting parameters, the inputs including input signals characterized by at least two different control protocols, the input signals including a first input signal defining a color ratio and a second input signal defining an intensity, the first input signal being received from a color controller connected to the control system and configured to set the color ratio to define a desired output color, the second input signal being received to the control system from a dimmer configured to set the intensity; and outputting at least one output signal by the control system to control the color ratio and the intensity of the lighting system based at least in part on the inputs.

17. The method of claim 16, further comprising combining the input signals such that the output signal includes a single control protocol.

18. The method of claim 16, wherein the lighting system includes a plurality of lighting fixtures, the method further comprising sending at least a first output signal to at least some of the lighting fixtures.

19. The method of claim 18, wherein the first output signal controls at least one of the at least some of the lighting fixtures differently from at least one other of the at least some of the lighting fixtures.

20. The control system of claim 1, wherein the first input signal defines the color ratio using red green blue amber (RGBA) channels driving corresponding red, green, blue, and amber colored lights of the lighting system.

21. A control system for controlling a lighting system, comprising:

a control system including at least one microprocessor and configured to receive a plurality of inputs defining respective lighting parameters, the inputs including input signals characterized by at least two different control protocols, the input signals including a first input signal defining a color ratio and a second input signal defining an intensity; and use the input signals to control the color ratio and the intensity of the lighting system load the first input signal from a first personality stored to a memory, the first personality defining the color ratio in terms of first values of a plurality of different color channels;

receive the second input signal from a dimmer control; and combine the input signals to control the color ratio in accordance with the first personality and the intensity in accordance with the dimmer control.

22. The control system of claim 21, further configured to:

responsive to receipt of an indication to switch lighting personalities:

load the first input signal from a second personality stored to the memory, the second personality defining the color ratio in terms of second values of the RGBA channels, the second values defining a different color than the first values; and combine the input signals to control the color ratio in accordance with the second personality and the intensity in accordance with the dimmer control.

23. The control system of claim 1, wherein the at least two different control protocols include one or more of Bluetooth communications, infrared, ZigBee, Casambi, WiFi, wireless mesh, DALI, and/or DMX.

* * * * *